United States Patent [19]

Revelin et al.

[11] Patent Number: 4,939,872

[45] Date of Patent: Jul. 10, 1990

[54] HONING MACHINE WITH ROTATING PLATE HAVING AT LEAST ONE HEAD WHICH DOES NOT ROTATE WITH RESPECT TO THE PLATE

[76] Inventors: Evaristo Revelin; Diego Revelin; Fulvio Revelin, all of Aldo Noro, 7 - Isola Vicentina, Vicenza

[21] Appl. No.: 262,315

[22] Filed: Oct. 25, 1988

[30] Foreign Application Priority Data

Oct. 27, 1987 [IT] Italy ..... 85.625 A/87

[51] Int. Cl.[5] ..... B24B 23/02

[52] U.S. Cl. ..... 51/180; 51/170 T; 404/112; 15/98

[58] Field of Search ..... 51/180, 170 R, 170 T, 51/174, 177, ; 404/112; 15/49 R, 49 C, 98

[56] References Cited

U.S. PATENT DOCUMENTS 1,044,423 11/1912 Rosa ..... 51/180

1,947,286 2/1934 Bitterbaum ..... 51/180

FOREIGN PATENT DOCUMENTS 1164791 5/1958 France ..... 51/180

253756 6/1926 United Kingdom ..... 51/180

*Primary Examiner*—Roscoe V. Parker

*Attorney, Agent, or Firm*—Bucknam and Archer

[57] ABSTRACT

The honing apparatus comprises a dolly 1 on which is mounted an electric motor 2 and a reservoir for water 3. A flexible cable 4 emerges from the command motor and within this cable is located a flexible command cable which by means of a reducing adapter located at the end is connected with an assembly 8 and imparts rotation to the plate 6. The plate carries the operating heads 7 which provide for smoothing the plaster both on vertical walls as well as ceilings. The apparatus also provides for spraying water by means of tube 5 if this is necessary.

7 Claims, 6 Drawing Sheets

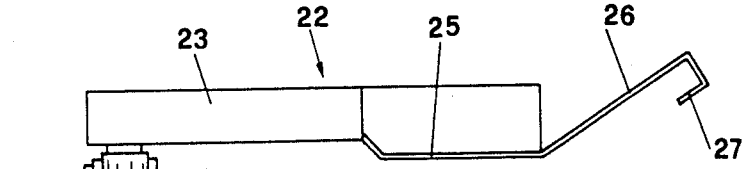
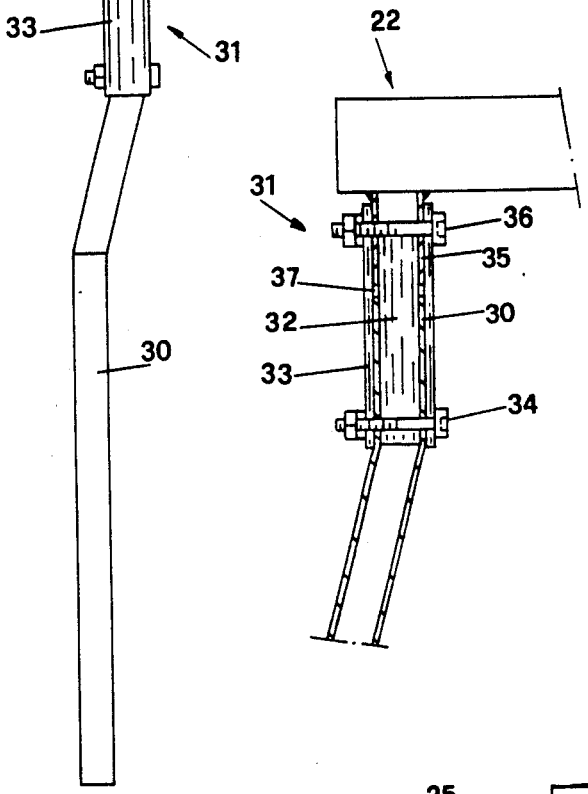
FIG. 13
FIG. 15
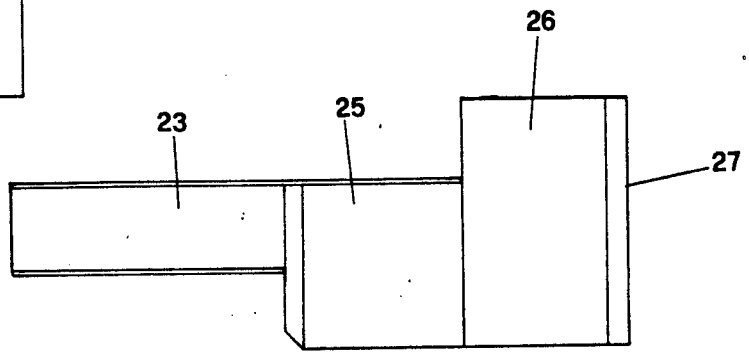
FIG. 14

HONING MACHINE WITH ROTATING PLATE HAVING AT LEAST ONE HEAD WHICH DOES NOT ROTATE WITH RESPECT TO THE PLATE

The present invention relates to apparatuses for removing plaster from walls and ceilings and more specifically to apparatuses which are intended to remove completely the plaster previously applied on face works, for instance by means of a conventional plastering trowel. It is known that when the plaster has to be removed to the condition usually called total, a blade or a slicker is ordinarily used with which the mortar is perfectly smoothed so as to render the mortar perfectly flat on the exterior surface prior to the time it hardens.

The apparatus according to the present invention is intended to achieve the same result by mechanical means and with less physical work and in less time.

The apparatus according to the present invention comprises essentially one or more heads provided with tools, which are carried by a mechanical device. The mechanical device causes the plates to rotate while the heads remain fixed on their pivoting shaft so that it is possible to remove completely and automatically the plaster without requiring the conventional blade or the plastering trowel.

The mechanical device is put in rotation by means of a metallic cable which rotates and is flexible and which is enclosed in a sheath. The cable exits from the command device which is mounted on a movable dolly on wheels lying on the ground so that the operator may carry the device either directly by hand when work is carried out on a vertical wall or he may carry it hanging on his shoulders by means of a belt when it is necessary to work on a ladder or on a scaffolding for the purpose of removing completely the plaster of a ceiling. In this case it is convenient to provide an extensible elastic support which facilitates the work on the ceiling itself. It is also possible to cause the pivot of the plate to rotate eccentrically on its axis for the purpose of causing an elliptical motion of the same plate during operation, a fact which causes the work of the device more similar to the work of the hand of the operator.

An important feature of the present invention is the fact that the heads of the device which slide on the plaster are supported by elastic means applied to the end of the rotating plate carried by the device, a fact which causes the contact between the device and the plaster more sensitive and lighter during operation for the purpose of avoiding damage to the paste, damage which would be difficult to remedy.

Another feature of novelty is the easy interchangeability of the operating heads which could be substituted by other heads with different properties and different objects.

The invention will now be described in more detail with reference to the accompanying drawings of which:

FIG. 13 is a side view of the supporting of this assembly;

FIG. 14 is a top view of the same;

FIG. 15 is a cross-section of the articulated joint which is part of the same device.

Figure 1:
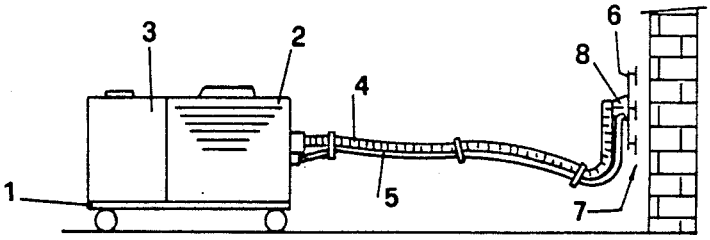
FIG. 1 is an overall schematic side view of the apparatus according to the present invention.

As shown in FIG. 1 the honing apparatus of the present invention comprises a movable dolly 1 on which are mounted the control part of the apparatus 2 which comprises an electric motor which puts in rotation the rotating plate 6, a water pump or a pump of the refrigerating liquid contained in the dolly 1, as well as reservoir 3 which contains the liquid being sprayed on the operating heads 7 and on the wall where they operate.

Numeral 4 is a flexible command cable. The cable 4 and the tube 5 for the refrigerating liquid terminate on the rotating plate 6 which carries the operating heads 7.

Figure 2:
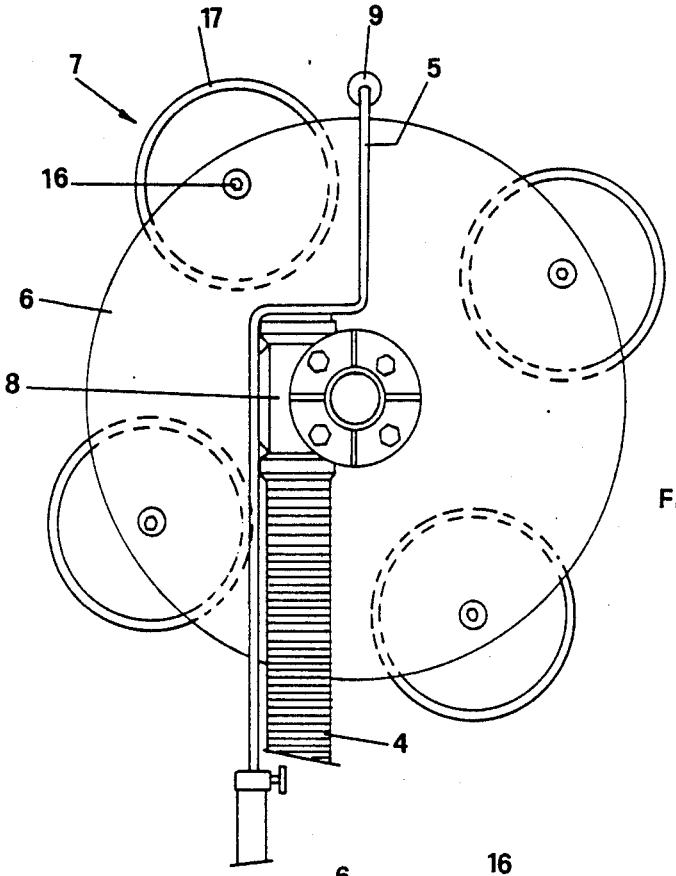
FIG. 2 is a top view of a plate having four heads for the apparatus of the present invention.

FIG. 2 shows the rotating plate 6 which has a shape of a circular crown and which carries according to a first embodiment the operating heads 7 in the number of four and which is placed in rotation by the worm-helicoidal wheel 8, the latter being actuated by the flexible command tube 4 which exits from the electric motor supported by dolly 1.

The tube 5 carries the water or other suitable liquid to the spray feed opening 9 which is located exteriorly with respect to the rotating plate 6. The spray feed opening 9 sprays water or other cooling liquid on the plane of the work on which the operating heads 7 work. Naturally, the number of four heads on a single rotating plate as in FIG. 2 is merely by way of illustration because the plate could carry also a different number of heads, for instance, one or five, always within the scope of the present invention.

Figure 3:
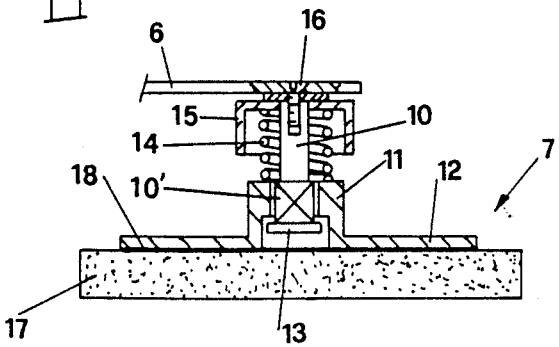
FIG. 3 is a cross-section of a side view of one operating head.

FIG. 3 shows in cross-section one of the operating heads 7 which are elastically fixed to the plate 6 by means of pin 10 which has in the lower part 10' a square section which goes through the opening, the latter also in square section formed through the neck 11 of smaller diameter of flange 12, within which the head 13 of the pin 10 is held.

Spring 14 compressed between the neck 11 of narrow diameter of flange 12 and the guiding cap 15, is held in position fixed to the plate 6 by means of screw 16, which is for instance, a lock screw, which makes possible only limited motion of the operating head 7 in the vertical direction. The operating head 7 may, in addition, undergo limited oscillations with respect to the plane of the work due to the fact that the square opening formed in the neck 11 of flange 12 has dimensions slightly greater than the square section of the portion 10' of pin 10.

FIG. 3 also shows that the device 17 and flange 12 are held together with velcro 18. It is clear, therefore, that it is very easy to substitute rapidly one device with another.

Figure 4:
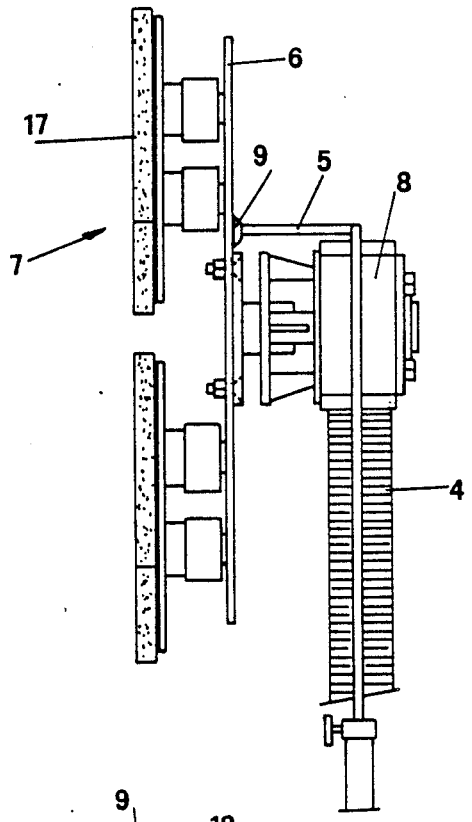
FIG. 4 is a profile view of the plate which comprises four heads.
Figure 5:
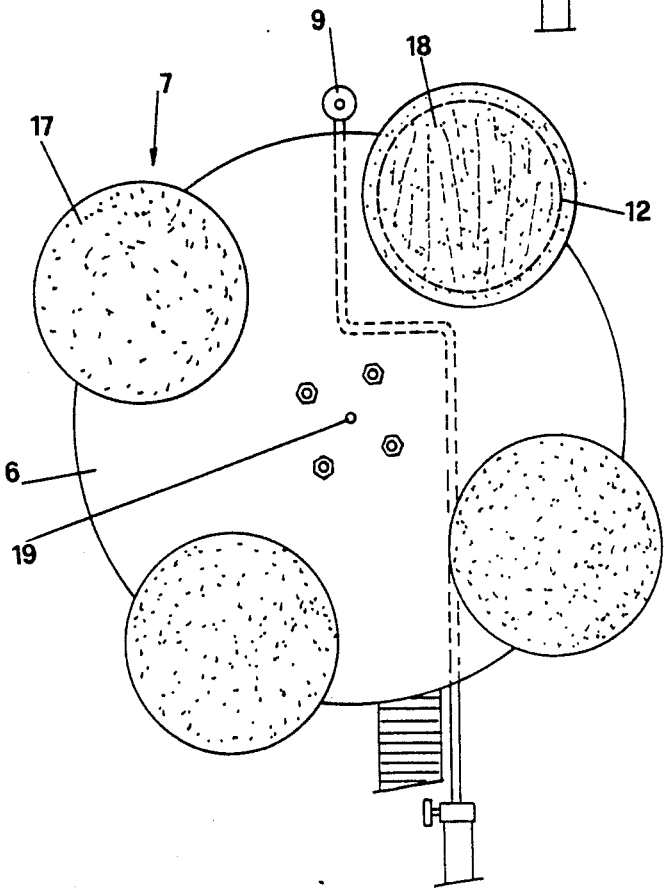
FIG. 5 is a bottom view of the same with one of the devices disassembled.

FIGS. 4 and 5 show the four operating heads 7 with the rotating plate 6. Specifically it is possible to see in FIG. 5 the head with the device 17 separated and velcro 18 on the flange 12.

It is also possible to apply over the four operating heads by means of velcro a single device so as to render possible an apparatus with a single operating head. In addition, opening 19 is provided in the plate 6 which permits to fix a fifth operating head.

Figure 6:
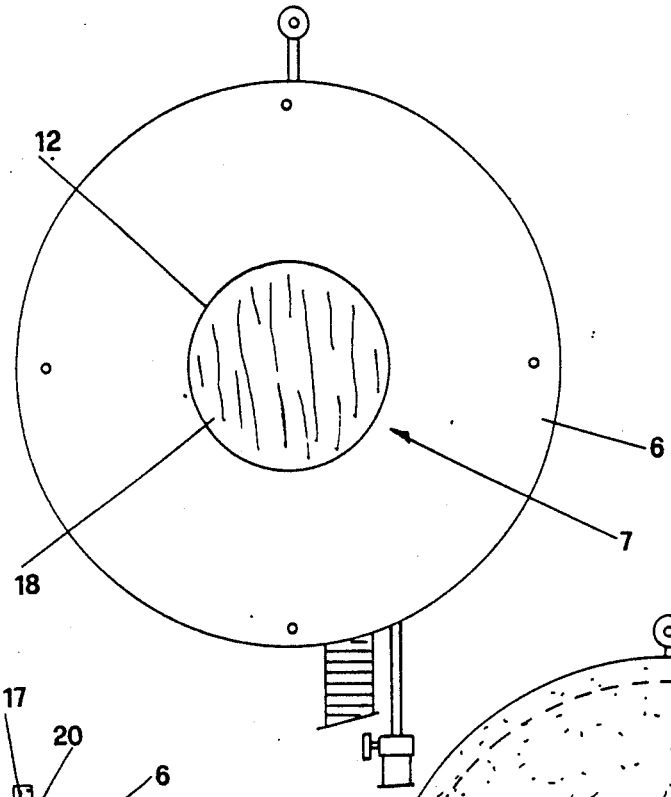
FIG. 6 is a bottom view of the plate according to one specific embodiment with only one operating head.
Figure 8:
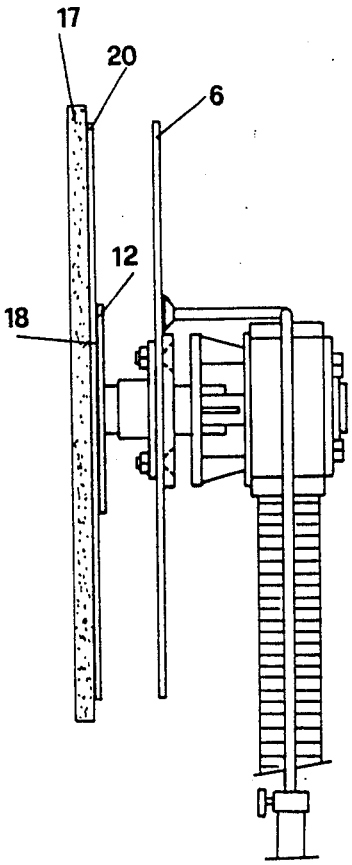
FIG. 8 is a side view of the same plate.
Figure 7:
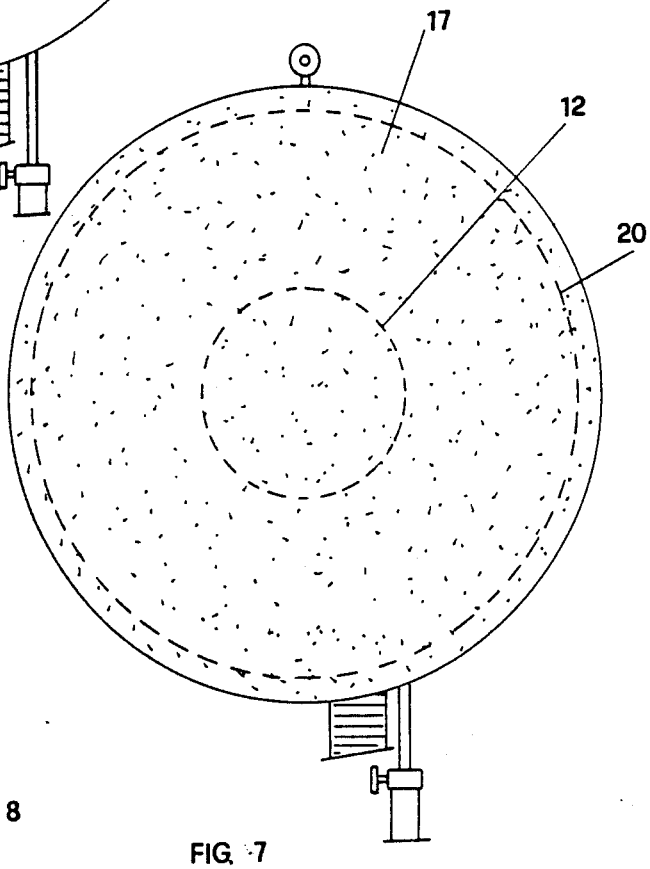
FIG. 7 is the same as FIG. 6 but the device for removing the plaster has been connected.
Figure 9:
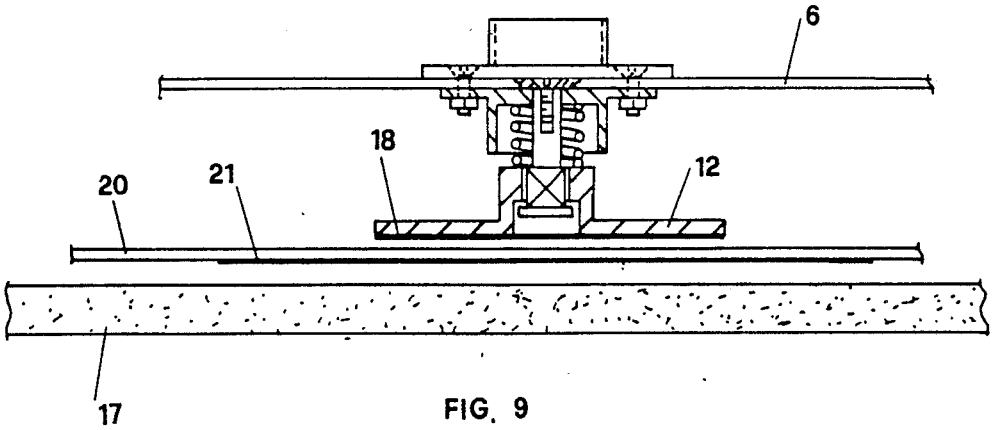
FIG. 9 is a side view in cross-section of the head with the elements separated.

FIGS. 6, 7, and 8 show that it is possible through opening 19 to mount a single central operating head 7 as shown in FIG. 6. FIG. 8 shows that by means of velcro 18 it is possible to fix in the operating head 7 the first support 20 made of rigid material and then the device 17 so as to obtain an apparatus similar to the apparatus described hereinabove. FIG. 9 shows the portion illustrating the mounting of the operating head. Specifically FIG. 9 shows flange 12 provided in the lower part with a first layer of velcro 18 to which is fixed the support 20. Also the latter is provided with a layer of velcro 21 in its lower part so that the device 17 may be fixed to it.

Figure 10:
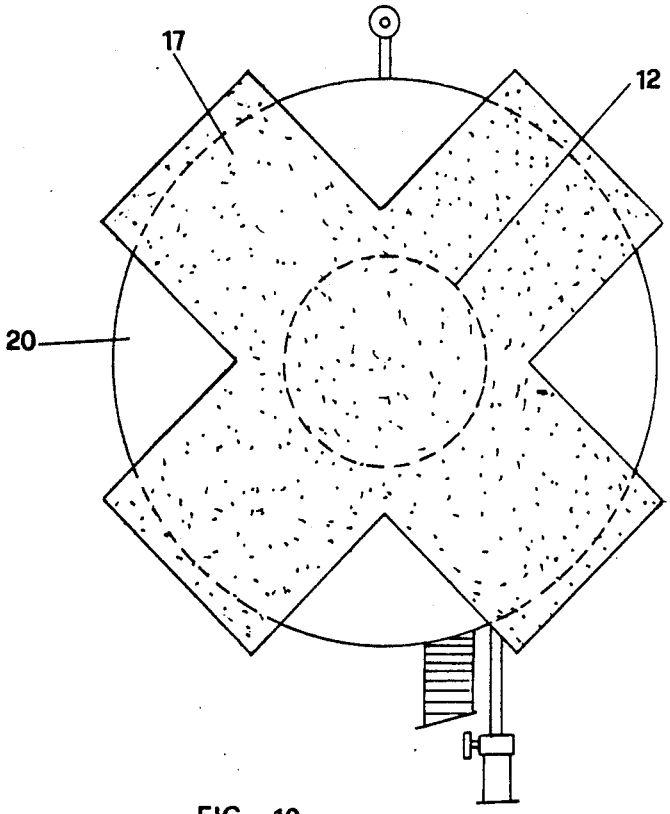
FIG. 10 is a bottom view of the plate with one head having applied the device according to another embodiment.

FIG. 10 illustrates another embodiment of the device 17 fixed to the apparatus described hereinabove. Clearly the same type of device may be fixed either in the apparatus which comprises only one head as well as in the apparatus which comprises a plurality of heads.

Another feature of the present invention consists of providing a support on which is located the assembly worm-helicoidal wheel 8 with related device having operating heads for the removal of the plaster from ceilings.

Figure 11:
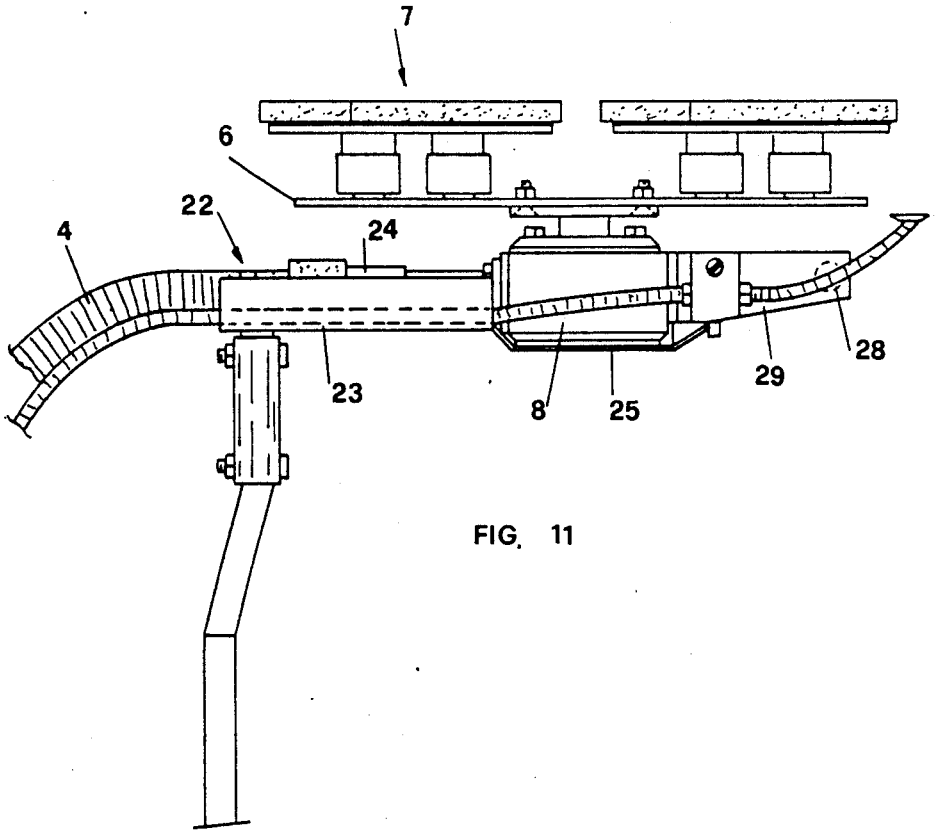
FIG. 11 is a side view of the support with the plate and multiple operating heads for removing the plaster on the ceilings.
Figure 12:
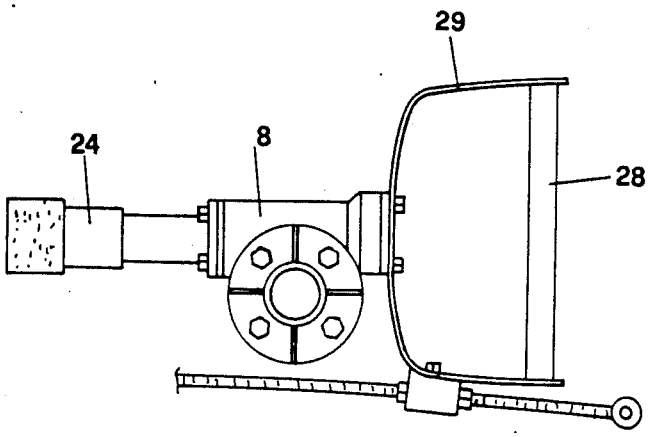
FIG. 12 is a top view of the assembly of the worm (Archimedean) screw helicoidal wheel which controls the rotation of the plate.

FIGS. 11, 12, 13, 14 and 15 better illustrate this feature of this invention. FIG. 11 shows the support 22 in which group 8 is located with the rotating plate 6 being fixed to the group 8 with corresponding operating heads 7. The operation of the assemblies mentioned hereinabove remains the same. Support 22 comprises a first rectilinear portion 23 provided in the upper part with tongue 24 which is fixed to the coupling for the flexible tube. The support also comprises a second portion 25 in which group 8 is located and a third inclined portion 26 shown in FIG. 13. This inclined portion has a slot 27 at the end which engages pivot 28 mounted on yoke 29, the latter being fixed to the assembly 8 as shown in FIG. 12. The shape of the support 22 guarantees in this manner a firm fixing of the assembly 8 in the apparatus with one or more operating heads which can never become unhooked from the apparatus.

The support 22 is completed by stem 30 shown in FIGS. 13, 14 and 15. Stem 30 in the upper part is connected to the same support by means of joint 31. The function of the joint 31 is to render the support 22 elastic so that the device with operating heads may adapt itself to every type of ceiling.

FIG. 15 shows that the stem 30 is internally hollow and an insert of rubber 32 is inserted in it. After the insertion of insert 32 and of another coupling 33 which is inserted externally in the stem 30, the entire assembly is blocked by screw 34 so as to prevent any motion of the two parts made of rubber.

At this point the upper part of insert 32 protruding a few centimeters permits the insertion internally of another portion of stem 35 which is hollow and fixed to support 22. After carrying out the connection between the two hollow portions 30 and 35 of the stem and after the coupling 33 is inserted externally with respect to the latter, a second screw 36 completes the joint 31.

The drawing also shows that between the two portions of stem 30 and 35 connected by the insert 32 there is formed a space 37 which gives elasticity to the entire support 22.

What is claimed is:

1. A honing apparatus for removing plaster from a wall or a ceiling which comprises a dolly supporting mechanical moving means and a reservoir for water or other cooling liquid for spraying on said plaster, a flexible tube (4), a rotating command cable inserted therein, a second flexible tube (5) parallel to said flexible tube (4), said tube (5) connected to said reservoir and containing the water or liquid for spraying on the plaster, said flexible tube (4), and said flexible tube (5) exiting from said dolly at one end, a rotating plate (6) located at the other end of said flexible tube (4), said plate carrying at least one operating head (7), said operating head being fixed with respect to said rotating plate (6) and being provided with means for smoothing said plaster completely prior to the time said plaster becomes hardened, said apparatus being carried by an operator either vertically for honing a vertical wall or horizontally for honing the plaster on a ceiling, wherein said head (7) is provided with a flange (12), said flange having a central neck (11), said neck having a central square opening, said head being mounted on the portion (10') of pin (10), said pin (10) emerging downwardly with respect to said rotating plate (6), said head being fixed thereto by means of a screw (16), spring (14) located between said neck and said screw, whereby rotation of said head with respect to said plate (6) is prevented and said head only oscillates elastically with respect to said plate whereby the honing action on said plaster is rendered more effective and more rapid with definite advantages with respect to the quality of the finished work and the rapidity of carrying out the work.

2. The apparatus according to claim 1 wherein said plate being placed in rotation by means of an electric motor through said flexible tube (4) and a worm-helicoidal wheel (8) being elastically connected to said screw (16) whereby an oscillation of the surface of work with respect to the plane of operation is achieved.

3. The honing apparatus according to claim 1 wherein means (17) are mounted on said flange (12) elastically connected to said rotating plate (6) by means of a coupling consisting of velcro (18) whereby substitution depending upon the particular requirements of the operation is easily and rapidly carried out.

4. The honing apparatus according to claim 1 wherein a single means (17) is fixed on at least four operating heads (7) to mount said heads on said rotating plate.

5. A honing apparatus for removing plaster from a wall or a ceiling which comprises a dolly supporting mechanical moving means and a reservoir for water or other cooling liquid for spraying on said plaster, a flexible tube (4), a rotating command cable inserted therein, a second flexible tube (5) parallel to said flexible tube (4), said tube (5) connected to said reservoir and containing the water or liquid for spraying on the plaster, said flexible tube (4) and said flexible tube (5) exiting from said dolly at one end, a rotating plate (6) located at the other end of said flexible tube (4), said plate carrying at least one operating head (7), said operating head being fixed with respect to said rotating plate (6) and being provided with means for smoothing said plaster completely prior to the time said plaster becomes hardened, said apparatus being carried by an operator either vertically for honing a vertical wall or horizontally for honing the plaster on a ceiling, wherein said mechanical moving means consist of a support (22) provided with a stem (30) and an elastic joint (31) and an assembly (8) of worm-helicoidal wheel actuated by an electric motor, said electric motor being located on said dolly whereby the plaster may be easily removed from a ceiling.

6. The honing apparatus according to claim 5 wherein said support (22) is rendered elastic by means of said joint (31), said joint (31) comprises two sections (30) and (35), connected by a rubber insert (32), said sections (30) and (35) being inserted within a coupling (33), being blocked by screws (34) and (36).

7. The honing apparatus according to claim 5 wherein between said two portions (30) and (35) connected by rubber insert (32), a space (37) is provided, said space allowing elasticity of the joint (31) which carries said support (22).

* * * * *